US006527310B1

(12) United States Patent
Bellamy

(10) Patent No.: US 6,527,310 B1
(45) Date of Patent: Mar. 4, 2003

(54) SLAM BOLT LOCK

(75) Inventor: Dirk L. Bellamy, Salem, OR (US)

(73) Assignee: GE Interlogix, Inc., Salem, OR (US)

( * ) Notice: Subject to any disclaimer, the term of this patent is extended or adjusted under 35 U.S.C. 154(b) by 0 days.

(21) Appl. No.: 09/465,417

(22) Filed: Dec. 16, 1999

Related U.S. Application Data

(60) Provisional application No. 60/112,444, filed on Dec. 16, 1998.

(51) Int. Cl.[7] ..... E05C 1/06
(52) U.S. Cl. ..... 292/144
(58) Field of Search ..... 292/144, 169, 292/71, 65

(56) References Cited

U.S. PATENT DOCUMENTS 202,474 A * 4/1878 Ruggles
1,220,210 A * 3/1917 Epling
2,482,959 A * 9/1949 Anderson et al. ..... 292/63
3,799,591 A 3/1974 Taniyama
3,890,813 A * 6/1975 Cothron ..... 70/92
3,951,442 A 4/1976 Schlage
4,056,276 A * 11/1977 Jarvis ..... 292/201
4,135,746 A * 1/1979 Sterling ..... 292/92
6,007,115 A * 12/1999 Ruth ..... 292/71

FOREIGN PATENT DOCUMENTS

DE 736 725 6/1943
DE 44 30 736 C1 11/1995

* cited by examiner

*Primary Examiner*—J. J. Swann
*Assistant Examiner*—Dinesh N Melwani
(74) *Attorney, Agent, or Firm*—Klarquist Sparkman, LLP

(57) ABSTRACT

A two-way slam bolt controllably locks a bolt against retraction when impacted on one side by a doorjamb, while still permitting free retraction when impacted on the other side. The preferred embodiment employs a U-shaped bolt that must tilt in one of two directions for retraction.

11 Claims, 6 Drawing Sheets

SLAM BOLT LOCK

This application claims the benefit of U.S. Provisional Application No. 60/112,444, filed Dec. 16, 1998.

FIELD OF THE INVENTION

The present invention relates to locks, and more particularly relates to slam bolt locks.

BACKGROUND AND SUMMARY OF THE INVENTION

Slam bolts are well known and are typically characterized by bolts that retract in response to impacts with door jambs.

Household doors are a familiar example of slam bolts. An open door can be pushed closed without manually retracting the bolt; the doorjamb pushes the bolt into the door (against a spring biasing force), permitting closure of the door.

Household doors typically employ one-way slam bolts—the bolt is beveled on just one side. By beveling the bolt on both sides, a two-way slam bolt is achieved. If such a bolt is used on a household door, not only can the door be pushed closed, the door can also be pushed open. Either movement pushes the bolt into the door (by force of the door jamb against the beveled bolt face). Although not typically used in household doors, such two-way slam bolts are commonly used in other contexts.

In accordance with one aspect of the present invention, a two-way slam bolt is improved by locking the bolt against retraction when impacted on one side by a door jamb, while still permitting free retraction when impacted on the other side.

The foregoing and other features and advantages of the present invention will be more readily apparent from the following detailed description, which proceeds with reference to the accompanying drawings.

DETAILED DESCRIPTION

Figure 1:
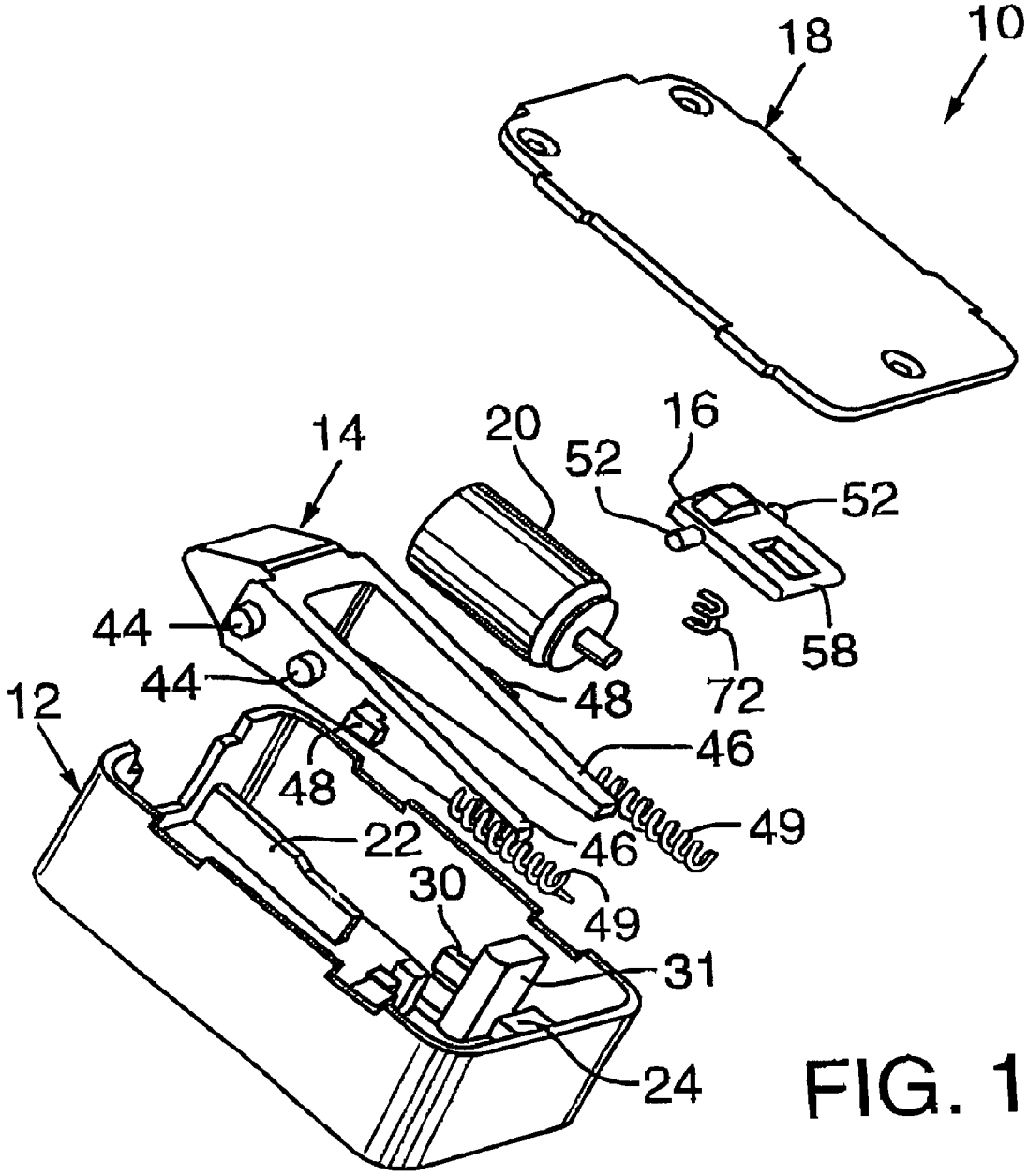
FIG. 1 is an exploded view of a lock according to one embodiment of the present invention.

Referring to the figures, a lock 10 according to one embodiment of the invention includes a body 12, a bolt 14, a redirecting lever 16, a lid 18, and a solenoid 20.

Figure 3A:
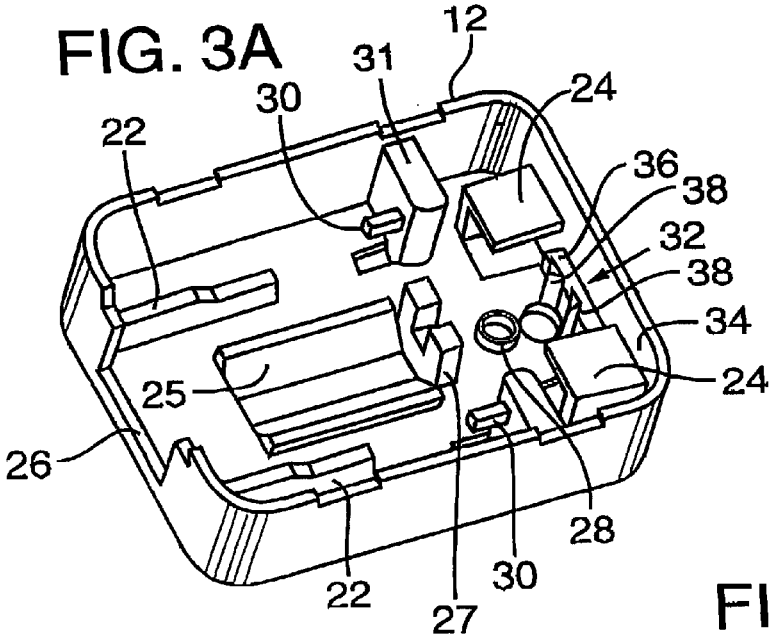
FIGS. 3A–C are views of a body used in the lock of FIG. 1.
Figure 3B:
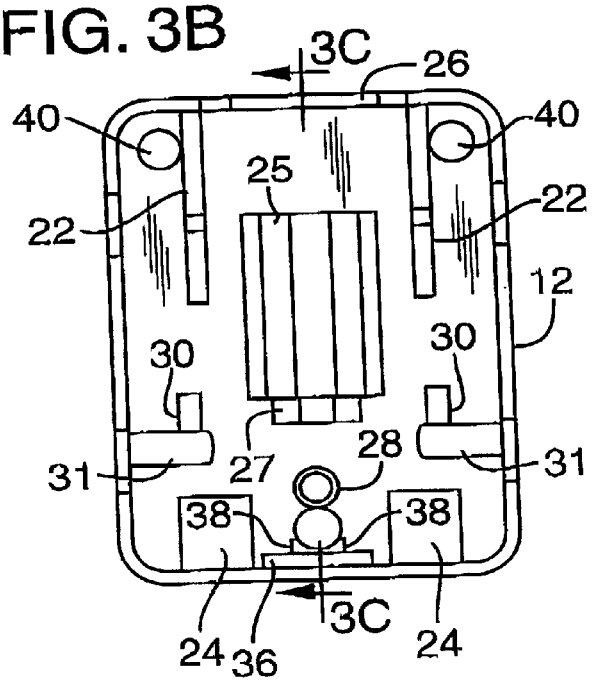
Figure 3C:
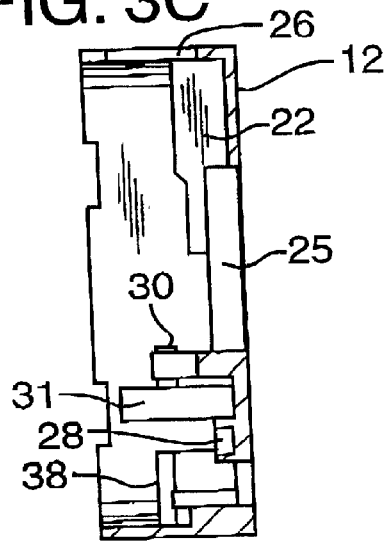
Figure 4A:
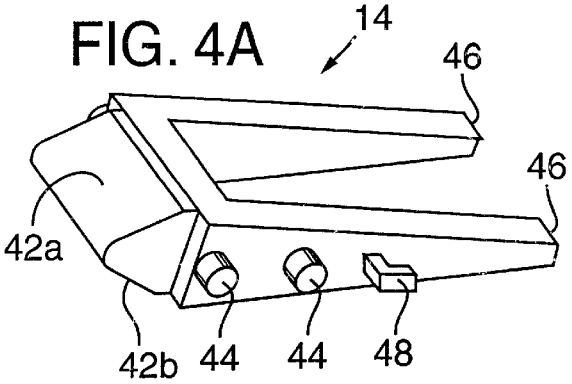
FIGS. 4A–C are views of a bolt used in the lock of FIG. 1.
Figure 4B:
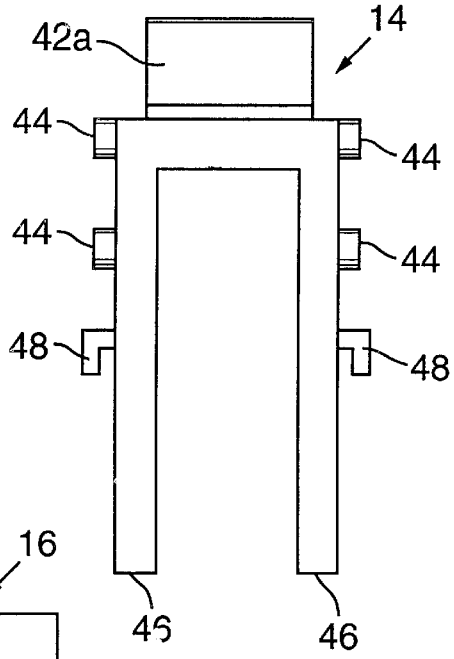
Figure 4C:
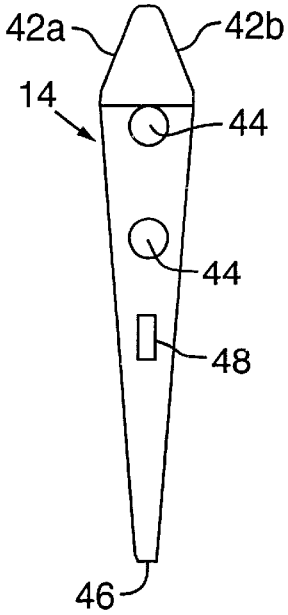
Figure 5B:
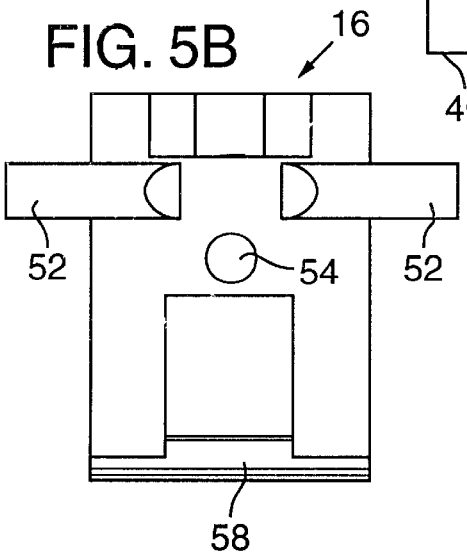
FIGS. 5A–D are views of a redirecting lever used in the lock of FIG. 1.
Figure 5C:
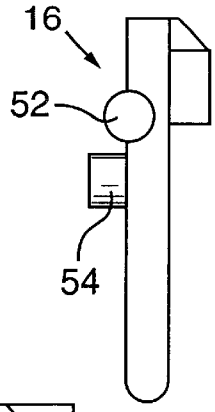
Figure 5A:
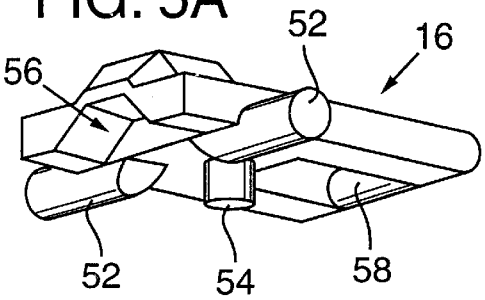
Figure 5D:
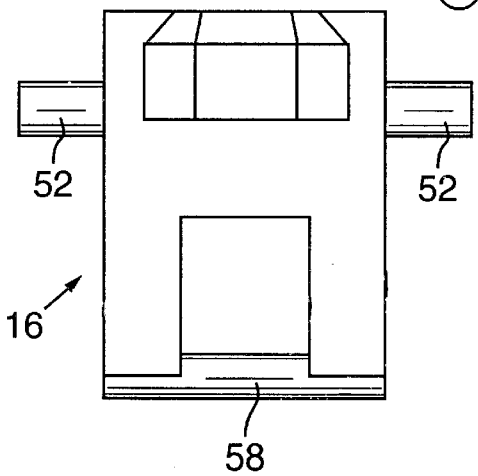
Figure 6A:
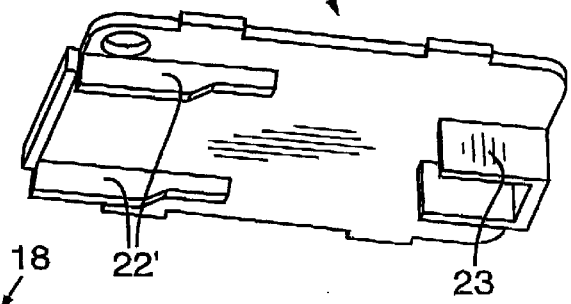
FIGS. 6A–C are views of a lid used in the lock of FIG. 1.
Figure 6B:
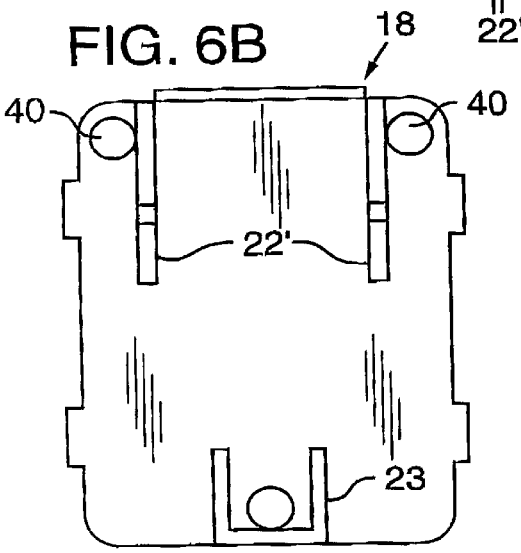
Figure 6C:
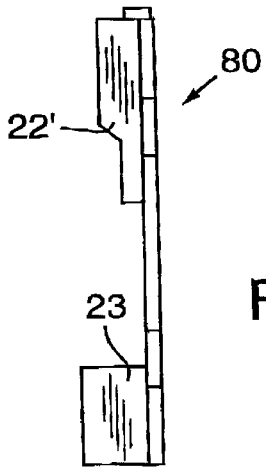
Figure 7C:
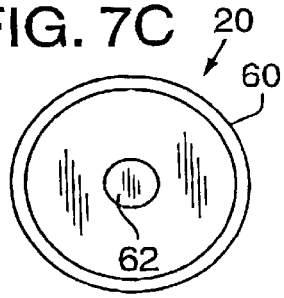
FIGS. 7A–C are views of a solenoid used in the lock of FIG. 1.
Figure 7A:
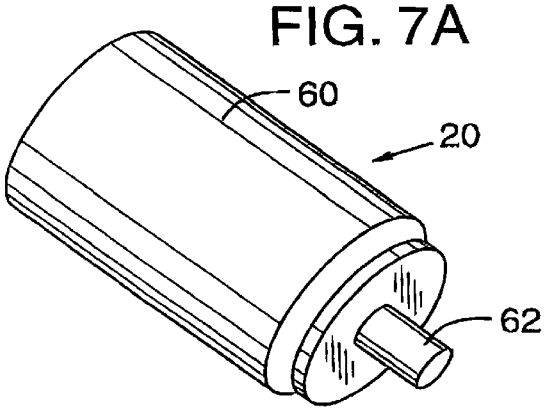
Figure 7B:
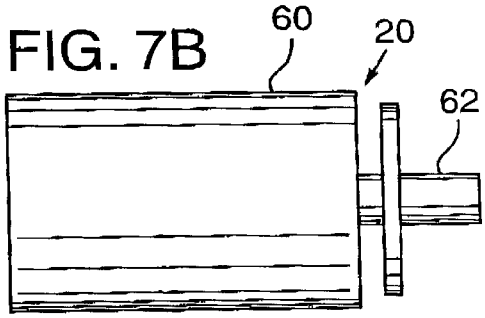
Figure 8A:
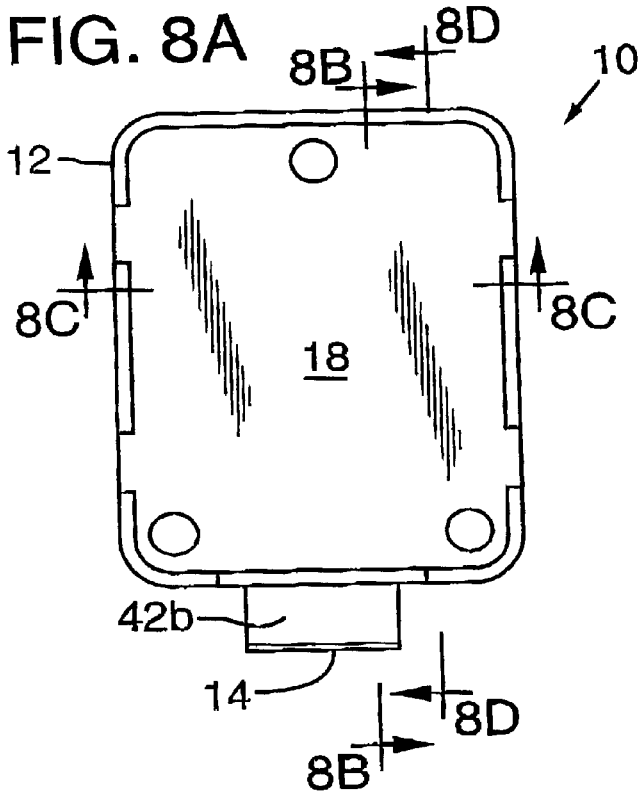
FIGS. 8A–D are additional views of the assembled lock of FIG. 1.
Figure 8B:
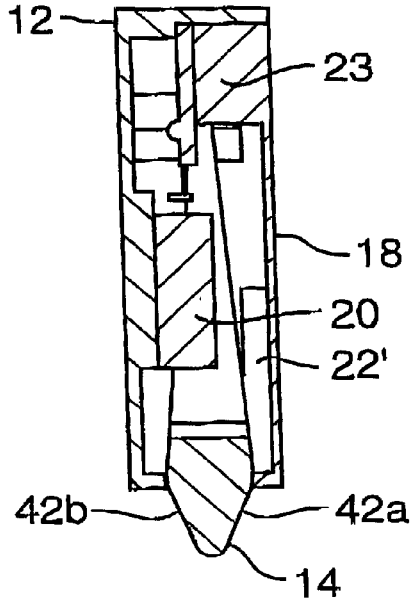
Figure 8C:
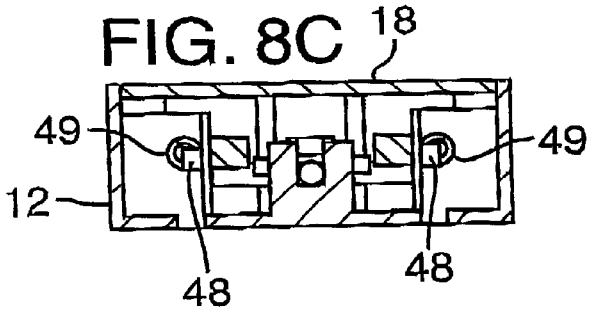
Figure 8D:
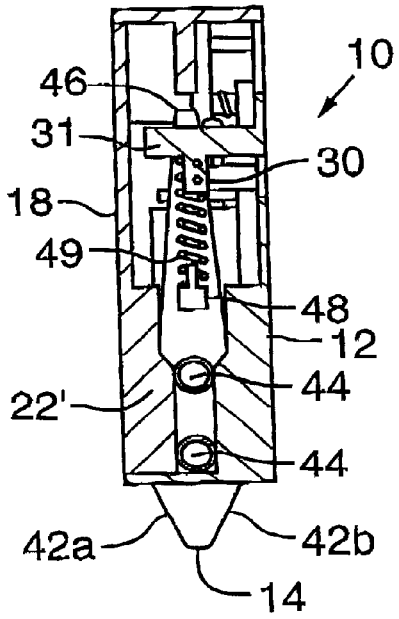

Body 12 includes various features, as depicted in FIGS. 3A–C. Among these features are a pair of ramps 22, a pair of bolt-end blockers 24, a solenoid cradle 25 including an end brace 27, a cut-out 26 for the bolt, a lever spring nest 28, a pair of spring-receiving nibs 30 on supports 31, and a lever-receiving cradle 32 (defined by the rear wall 34, a shelf 36, and a pair of upright braces 38). The body additionally includes three mounting holes 40.

Bolt 14 is U-shaped and includes two inclined jamb-striking faces 42*a*, 42*b*, four cylindrical protrusions 44 (two on each side), a pair of tapered bolt-ends 46, and a pair of spring-receiving nibs 48. (Springs 49 are compressed between these nibs 48, and nibs 30 in the cradle, serving to spring-bias the bolt out of the body.)

Redirecting lever 16 includes a pair of outwardly-extending cylindrical arms 52, a spring-receiving nib 54, and solenoid-receiving nest 56, and a transverse pivot pin 58 (which is integrally formed with the lever, and forms a rounded end thereof).

Lid 18 includes a pair of ramps 22' like ramps 22 in the body 12. Lid 18 also includes a retaining feature 23.

Solenoid 20 includes a body 60 and a shaft 62. Shaft 62 is normally spring-biased to an extended position, away from body 60. When energized, the shaft retracts.

In operation, bolt 14 can never slide straight back into the housing (i.e. in a conventional retracting manner). Such a straight-back path is blocked by near-immediate engagement of the bolt with bolt-end blockers 24 (as shown best in FIG. 2D).

Figure 2A:
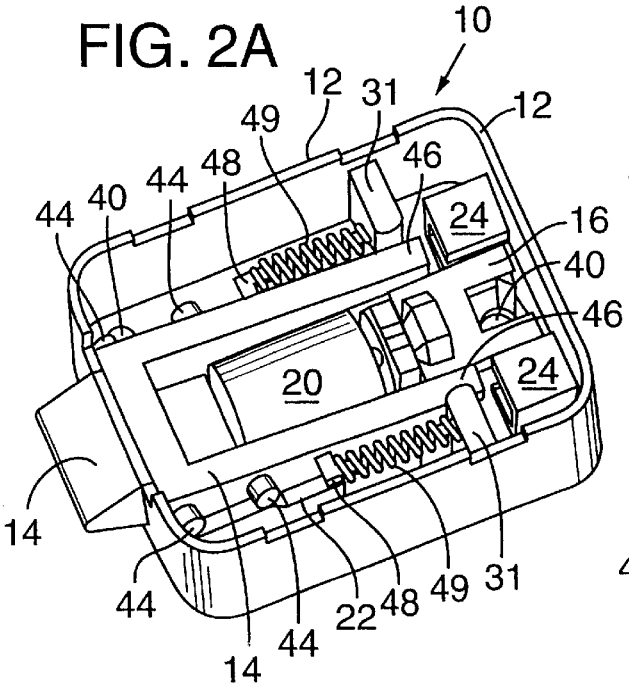
FIGS. 2A–D are additional views of the lock of FIG. 1.
Figure 2B:
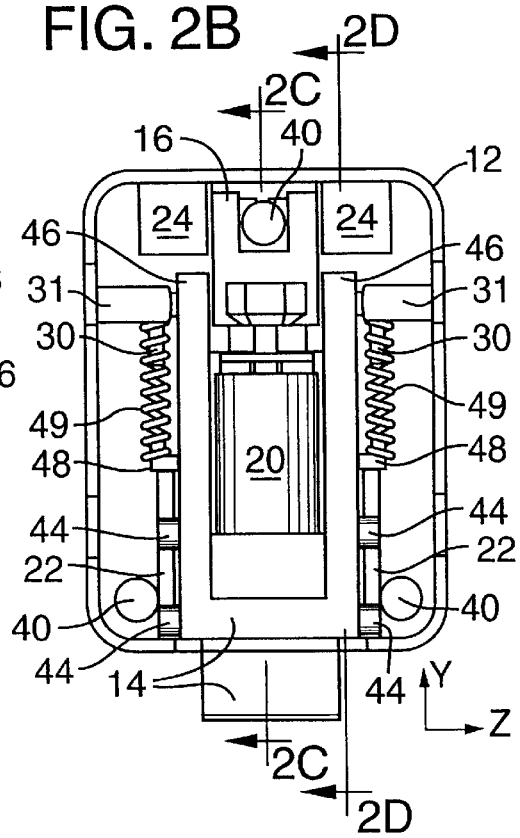
Figure 2C:
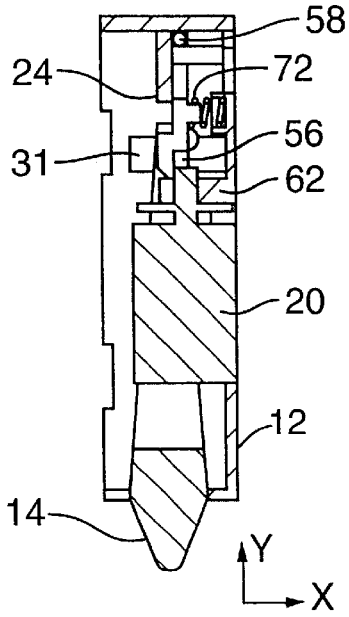
Figure 2D:
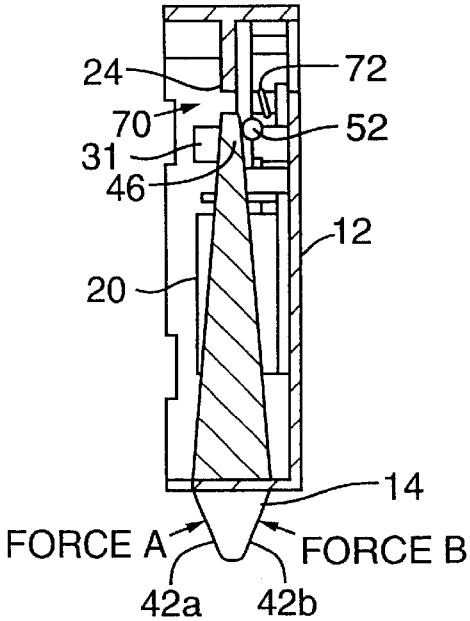

If bolt 14 is to move inwardly (i.e. to pass a doorjamb), it must tilt so that its internal bolt-ends 46 can slide to one-side or the other of the bolt-end blockers 24 (i.e. so bolt-ends 46 move to the left- or right-in FIG. 2D). Such tilting motion is caused in reaction to the bolt striking a door jamb.

Referring still to FIG. 2D, if face 42*a* of the bolt 14 is struck by a doorjamb, a force "A" is applied against the bolt towards the right. In reaction, the opposite end 46 of the bolt moves to the left, into an empty space 70. Part of the doorjamb force "A" is resolved, by the inclined surface 42*a* of the bolt, into a force urging the bolt into the housing. With nothing in space 70 to block such movement, the bolt slides into the housing and the door can be opened. (In such sliding, cylindrical protrusions 44 extending from the bolt slide along the ramps 22' in the lid 18.)

The just-described operation does not depend on the state of the solenoid 20. Whether the solenoid is powered or not, the bolt always responds to doorjamb forces against face 42*a* by permitting the bolt to tilt and retract into the lock housing.

This always-unlocked feature (as respects impacts against bolt face 42*a*) is typically used to assure that a door—once opened—can always be closed, regardless of the state of the lock. For such application, the lock is mounted so the face of the bolt that approaches the doorjamb upon closing is face 42*a*.

If the opposite face 42*b* of the bolt is struck by a doorjamb (e.g. if an attempt is made to push open a closed door), the bolt may or may not retract, depending on the state of the solenoid 20.

In the illustrations, solenoid 20 is in its un-energized state, i.e. with its shaft extended. In this state, the bolt cannot retract.

More particularly, shaft 62 in the illustrated position extends into the nest 56 in the underside of the lever 16. With the parts so-arranged, lever 16 cannot move downwardly (to the right in FIG. 2C). The back end 58 of the lever is resting in its cradle 32 (FIG. 3A), and the front end of the lever is braced against movement by the solenoid shaft.

In this state, if face 42*b* of the bolt is struck by the door jamb, a force "B" is applied against the bolt towards the left (see FIG. 2D). In reaction, the opposite end 46 of the bolt tries to move to the right. However, lever 16 prevents such movement. (More accurately, arms 52 extending from lever 16 block such movement.) Being constrained by the lever against such tilting movement, the doorjamb force "B" tends to urge the bolt straight-on into the housing. But, as noted earlier, such movement is prevented by near-immediate engagement of the bolt-ends 46 with the bolt blockers 24. Thus, no retracting movement of the bolt can occur.

If solenoid 20 is energized, the opposite result is obtained. With the solenoid energized, shaft 62 is withdrawn into solenoid body 60. Without the shaft extending into nest 56 of the lever, the only element holding the lever in the illustrated position is a biasing spring 72. (Biasing spring 72 extends between nib 54 on the lever 16, and the spring-receiving nest 28 in the body 12.) If a force "B" is applied to the left against face 42*b* of the bolt, the opposite end of the bolt will move to the right. With the lever 16 no longer braced by the solenoid shaft 62, rightward movement of bolt-ends 46 is permitted and will push the lever 16 to the right, compressing spring 72, and forcing the lever out of the bolt's way. Once tilted, the inwardly-directed component of the doorjamb force "B" urges the bolt up into the housing. This force causes the bolt to slide up and to the right of the bolt blockers 24, opening the lock. (In such sliding, cylindrical protrusions 44 extending from the bolt slide along the ramps 22 in the housing 11.)

From the foregoing, it will be apparent that the just-described arrangement provides a slam bolt that is novel in several respects. One is the provision of a bolt that always retracts when struck from one side, but that can be controllably locked against retraction when struck from the other. Another is a bolt that tilts in two opposite directions. Various other novelties will be apparent to those skilled in the art.

Having described and illustrated the principles of my invention with reference to a preferred embodiment, it should be apparent that the illustrated embodiment can be modified in arrangement and detail without departing from such principles.

For example, while the illustrated embodiment employs a solenoid actuator, other electrical actuators (e.g. motors, stepper motors, shape memory alloy, etc.) can alternatively be employed. Moreover, the actuator need not be electrical. Myriad mechanical devices/structures can similarly be employed to releasably secure lever 16 in the locked position. (The modification of the illustrated embodiment to accommodate such electrical and mechanical actuators is within the routine skill of an artisan in this field.)

Similarly, while the illustrated embodiment employs coiled springs to effect various biasing forces, in other embodiments other biasing arrangements (e.g. other types of springs, resilient elastomers, magnetic forces, etc.) can alternatively be employed.

The particular construction details of the illustrated embodiment are not critical. Given the foregoing disclosure, the artisan will recognize many other structures that can be employed to exploit the novel lock ideas detailed above. Thus, for example, many embodiments of the lock can dispense with lever 16, employing instead other structures to prevent right-tilting or -sliding of the bolt.

More generally, certain features of the illustrated embodiment find application beyond slam bolt locks. The two-way tilting bolt arrangement, for example, can be advantageously employed in locks of other types.

In view of the many embodiments in which the principles of my invention may be employed, it should be recognized that the foregoing embodiments are illustrative only and should not be taken as limiting the scope of the invention. Rather, I claim as my invention all such modifications as may come within the scope and spirit of the following claims and equivalents thereto.

I claim:

1. A lock comprising a housing, a bolt having first and second striking faces, an actuator having first and second positions, further comprising:

(a) means for permitting the bolt to tilt and retract when struck on the first face, regardless of whether the actuator is in first or second positions;

(b) means for permitting the bolt to tilt and retract when struck on the second face, if the actuator is in the first position; and (c) means for securing the bolt against retracting when struck on the second face, if the actuator is in the second position.

2. The lock of claim 1 in which the actuator is an electrical actuator.

3. The lock of claim 2 in which the electrical actuator includes a solenoid.

4. The lock of claim 1 in which the actuator is a mechanical actuator.

5. In a lock comprising a housing and a bolt, the bolt being mounted for movement relative to the housing, said movement including retraction and extension, an improvement wherein said movement also includes tilting in a first direction for a first retraction mode, and tilting in a second, opposite direction for a second retraction mode.

6. The lock of claim 5 wherein one of said tilting movements is prevented if an actuator is in a locked state.

7. The lock of claim 5 wherein only one of said tilting movements is prevented if an actuator is in a locked state.

8. A method of operating a lock having a bolt and a housing, the bolt having first and second striking faces, the method comprising:

(a) in response to a force applied to the first face, always permitting the bolt to tilt and slide into the housing; and (b) in response to a force applied to the second face, selectively permitting the bolt to tilt and slide into the housing.

9. A lock for a door, comprising:

a housing with one end positionable adjacent an edge of the door;

the end defining a bolt opening;

a bolt received in the housing and movable between a locked position and an unlocked position;

the bolt in the locked position extending from the housing and through the opening to a point beyond the housing, wherein the bolt in the locked position defining a first axis that extends substantially perpendicular to the opening; and the bolt in the unlocked position being retracted at least partially within the housing and tilted relative to the housing, wherein the bolt in the unlocked position defining a second axis that is not parallel with the locked axis.

10. The lock of claim 9, wherein the bolt has an outer end with two faces that are inclined in opposite directions.

11. The lock of claim 10, wherein the two faces are inclined by approximately equal angles in the respective directions.

* * * * *